US006235691B1

(12) United States Patent
Boffa et al.

(10) Patent No.: US 6,235,691 B1
(45) Date of Patent: May 22, 2001

(54) OIL COMPOSITIONS WITH SYNTHETIC BASE OILS

(75) Inventors: Alexander B. Boffa, Glen Gardner, NJ (US); Thomas R. Bidwell, Delaware, OH (US); Joe R. Noles, Jr., Belle Mead, NJ (US)

(73) Assignee: Exxon Chemical Patents Inc., Linden, NJ (US)

( * ) Notice: Subject to any disclaimer, the term of this patent is extended or adjusted under 35 U.S.C. 154(b) by 0 days.

(21) Appl. No.: 09/190,159

(22) Filed: Nov. 12, 1998

Related U.S. Application Data

(63) Continuation of application No. 08/968,696, filed on Nov. 12, 1997, now abandoned.

(51) Int. Cl.[7] ..... C10M 129/72
(52) U.S. Cl. ..... 508/482; 508/485
(58) Field of Search ..... 508/482, 485

(56) References Cited

U.S. PATENT DOCUMENTS

| | | | | |
|---|---|---|---|---|
| 3,271,315 | | 9/1966 | Mc Cabe | 508/485 |
| 3,974,081 | | 8/1976 | Ruthowski et al. | 508/482 |
| 4,053,491 | | 10/1977 | Koch et al. | 508/485 |
| 4,144,183 | | 3/1979 | Koch et al. | 508/485 |
| 4,313,890 | | 2/1982 | Chu et al. | 508/485 |
| 4,370,247 | * | 1/1983 | Ostyn | 508/482 |
| 4,464,277 | | 8/1984 | Cousineau et al. | 508/484 |
| 4,790,957 | * | 12/1988 | Mach et al. | 508/482 |
| 4,826,614 | * | 5/1989 | Watanabe | 508/482 |
| 5,458,794 | | 10/1995 | Bardasz et al. | 508/485 |
| 5,602,086 | | 2/1997 | Le et al. | 508/485 |
| 5,665,686 | | 9/1997 | Schlosberg et al. | 508/485 |

FOREIGN PATENT DOCUMENTS

| | | | |
|---|---|---|---|
| 0 496486 | 7/1992 | (EP) | C10M/111/04 |
| 02554668 | 8/1996 | (JP) | C10M/169/04 |
| WO 96/28525 | 9/1996 | (WO) . | |

* cited by examiner

*Primary Examiner*—Jacqueline V. Howard

(57) ABSTRACT

A lubricating oil composition is disclosed comprising at least 10% by weight of the total oil composition of an ester of phthalic acid having a viscosity index less than 100. The lubricating oil composition has improved fuel economy and wear performance.

11 Claims, No Drawings

OIL COMPOSITIONS WITH SYNTHETIC BASE OILS

This is a continuation-in-part of application Ser. No. 08/968,696 filed Nov. 12, 1997 now abandoned.

BACKGROUND OF THE INVENTION

Hydrocarbon oil compositions typically comprise a mixture of at least one hydrocarbon base oil and one or more additives, where each additive is employed for the purpose of improving the performance and properties of the base oil in its intended application; e.g., as a lubricating oil, heating oil, diesel oil, middle distillate fuel oil, and so forth. Lubricating oil composition face rather stringent viscosity requirements, as set, for example, by ASTM specifications. Such compositions must meet a minimum viscosity requirement at high temperature (i.e., at least about 100° C.) and a maximum viscosity requirement at low temperature (about −5° to −30° C.). Oil viscosity decreases with increasing temperature. A straight line drawn through viscosities of an oil at any two temperatures permits the estimation of viscosity at any other temperature, down to just above the cloud point. Such a straight line relates kinematic viscosity ν in $mm^2/sec$ (=cSt) to absolute temperature T (K) by the Walther equation, $$\log \log (\nu+0.7)=A+B \log T \quad (1)$$

The dimensionless viscosity index (VI), although empirical, is the most common measure of the relative decrease in oil viscosity with increasing temperature. A series of Pennsylvania petroleum oils exhibiting a relatively small decrease in viscosity with increasing temperature is arbitrarily assigned a VI of 100, whereas a series of Gulf Coast oils having viscosities that change relatively rapidly is assigned a VI of 0. From viscosity measurements at 40 and 100° C., the VI of any oil sample can be obtained from detailed tables published by ASTM (ASTM D2270).

Oils having a VI above 80 to 90 are generally desirable. These oils are composed primarily of saturated hydrocarbons of the paraffinic and alicyclic types which give long life, freedom from sludge and varnish, and generally satisfactory performance when they are compounded with proper additives for a given application. Lower VI oils sometimes are useful in providing low pour point for outdoor applications in cold climates and for some refrigeration and compressor applications.

Although the viscosity index is useful for characterizing petroleum oils, other viscosity-temperature parameters are employed periodically. Viscosity temperature coefficients (VTCs) give the fractional drop in viscosity as temperature increases from 40 to 100° C. and is useful in characterizing behavior of silicones and some other synthetics. With petroleum base stocks, VTC tends to remain constant as increasing amounts of VI improvers are added.

The minimum viscosity requirement at high temperature is intended to prevent the oil from thinning during engine operation to the point at which excessive engine wear and increased oil consumption would result. The maximum viscosity requirement at low temperature facilitates engine start-up in cold weather and also ensures that the cold oil has sufficient pumpability and flowability to avoid engine damage due to insufficient lubrication. However, in order to meet viscosity grade requirement, a minimum low temperature viscosity requirement must be maintained.

In formulating a lubricating oil composition which meets both the low and the high temperature viscosity requirements, a formulator can use a single lubricating base oil of desired viscosity or a blend of oils of different viscosities, and he can manipulate the kinds and amounts of additives that must be present to achieve not only the viscosity requirements, but also requirements specified for other properties, such as dispersancy, pour point and cloud point. Generally, the mere blending of oils having different viscosity characteristics does not enable the formulator to meet the low and high temperature viscosity requirements of lubricating oil compositions. Instead, the primary tool for meeting the requirements has been so far the use of viscosity index improving additives, hereinafter referred to as viscosity index improvers or, more simply, VI improvers.

Fuel economy is another important property to be considered when formulating oil. It is strongly dependent on base oil viscometrics. Many synthetic basestocks, in particular poly alpha olefins (PAO), have a high viscosity index and low cold cranking viscosity (ccs). Oils with these basestocks will have an elevated basestock viscosity at high temperature when blended to a given ccs viscosity grade limit (i.e. 5W). However, increased basestock viscosity leads to poor fuel economy.

Since an improvement in the fuel economy of synthetic oils is desirable, it would be advantageous to use a synthetic base oil having good fuel economy. This is surprisingly accomplished in the present invention by using esters of phthalic acid which provide an added fuel economy. In addition, the phthalic acid esters of the present invention also exhibit improved wear performance when used as a synthetic oil in lubricating applications.

Illustrative of a reference suggesting using synthetic oils is WO 96/28525 to Schlosberg et al. (Schlosberg), which discloses the use of polyol ester compositions with uncoverted hydroxyl groups. The polyol esters reportedly exhibit thermal and oxidative stability, lower frictions coefficients and improved wear in crankcase lubricating applications. However, Schlosberg does not disclose the use of phthalates and the inventors of the present application have found that phthalates have a superior combination of fuel economy and wear performance.

An article by L. Mattei, P. Pacor and A. Piconne in the Journal of Synthetic Lubricant entitled "Oil with Low Environmental Impact for Modem Combustion Engineer" 12-3, pgs 171–189, discloses the use of esters and the influence of viscosity on fuel efficiency. The article discloses that the chemical composition of the ester is an important factor in fuel efficiency. However, this article does not disclose the use of phthalates, nor suggests that the phthalates have improved fuel economy and wear performance.

U.S. Pat. No 3,974,081 to Rutkowski et al. discloses the use of phthalic acid esters for use as swelling seals in automatic transmissions, power transmissions, and rotary engines at up to 5% by volume. This patent does not disclose that higher concentrations of phthalates may be used, nor that phthalates exhibit improved fuel economy and superior wear performance.

SUMMARY OF THE INVENTION

This invention comprises a lubricating oil composition comprising at least 10% by weight of the total oil composition of an ester of phthalic acid having a viscosity index less than 100. A preferred embodiment of this invention is phthalic acid esters selected from the group consisting of: dioctyl phthalate, didecyl phthalate, diidodecyl phthalate, diisoctyl phthalate, diisononyl phthalate, diidodecyl phthalate, ditridecyl phthalate, di-n-butyl phthalate, diisobutyl phthalate and mixtures thereof.

The invention also discloses a method of improving fuel economy and wear of an internal combustion engine by treating the moving surfaces with a lubricating composition comprising at least 10% by weight of the total lubricating composition of an ester of phthalic acid having a viscosity index less than 100.

DETAILED DESCRIPTION OF THE INVENTION

The present invention provides a lubricating oil composition comprising at least about 10% to 50%, preferably about 15% to 40%, and more preferably about 20% to 35% by weight of the total oil composition of an ester of phthalic acid having a viscosity index less than 100, preferably less than 95, and more preferably less than 90. The inventors have discovered that the combination of lubricating base oil with phthalic acid esters of viscosity index less than 100 results in improved fuel efficiency and wear performance. Preferably, the ester of phthalic acid is selected from the group consisting of: dioctyl phthalate, didecyl phthalate, diidodecyl phthalate, diisoctyl phthalate, diisononyl phthalate, diidodecyl phthalate, ditridecyl phthalate, di-n-butyl phthalate, diisobutyl phthalate and mixtures thereof.

This composition may further comprise a mineral base oil such as mineral oils having a viscosity index above 110.

The compositions of the present invention find their utilities in lubricating compositions where additives are dissolved or dispersed and where at least 10% of the total composition comprises an ester of phthalic acid. Lubricants of the present invention can be prepared from a variety of natural and synthetic base stocks admixed with various additive packages and solvents depending upon their intended application. The base stocks typically include natural oils, highly refined mineral oils, poly alpha olefins (PAO), polyalkylene glycols (PAG), and silicone oils.

In a further embodiment, this invention involves a method of improving fuel economy and wear of an internal combustion engine by treating the moving surfaces thereof with a lubricating composition comprising at least 10% by weight of the total oil composition of an ester of phthalic acid having a viscosity index less than 100.

Natural Oils

Natural oils include animal oils and vegetable oils (e.g., castor, lard oil) liquid petroleum oils and hydrorefined, solvent-treated or acid-treated mineral lubricating oils of the paraffinic, naphthenic and mixed Paraffinic-naphthenic types. Oils of lubricating viscosity derived from coal or shale are also useful base oils.

Poly Alpha Olefins

Properties provided by the branched hydrocarbon chain structure of poly alpha olefin-containing fluids include high viscosity index in the 130–150 range, pour points of −50 to −60° C. for ISO 32 to 68 viscosity range (SAE 10W and SAE 20W, respectively), and high temperature stability superior to commercial petroleum products. In their use in many automotive oils, some ester synthetic fluid is normally included in the formulation to provide sufficient solubility for the approximately 20% additives now employed in many automotive oils.

Polyalkylene Glycols

The lubricating oil of the present invention may also comprise polyalkylene glycols have a number of characteristics that make them desirable as lubricants. Compared to petroleum lubricants, they have lower pour points, a higher viscosity index, and a wider range of solubilities including water, compatibility with elastomers, less tendency to form tar and sludge, and lower vapor pressure.

Silicon Oils

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl)silicate, tetra-(4-methyl-2-ethylhexyl)silicate, tetra-(p-tert-butylphenyl)silicate, hexa-(4-methyl-2-pentoxy)disiloxane, poly(methyl)siloxanes and poly (methylphenyl)siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Synthetic Hydrocarbons

The synthetic lubricating oils of the present invention may comprise an alkylate compound. These lubricating oils may also include hydrocarbon oils and halosubstituted hydrocarbon oils such as polymerized and interpolymerized olefins (e.g., polybutylenes, polypropylenes, propylene-isobutylene copolymers, chlorinated polybutylenes, etc.) poly(hexenes), poly(1-octenes), poly(1-decenes), etc. and mixtures thereof; alkylbenzenes (e.g., dodecyl-benzenes, tetradecylbenzenes, dinonylbenzenes, di-(2-ethylhexyl)-benzenes, etc.); polyphenyls (e.g., biphenyls, terphenyls, alkylated diphenyl ethers and alkylated diphenyl sulfides and the derivatives, analogs and homologs thereof and the like.

Oil Additives

The lubricating composition of the present invention can be used in the formulation of crankcase lubricating oils (i.e. passenger car motor oils, heavy duty diesel motor oils, and passenger car diesel oils) for spark-ignited and compression-ignited engines. The additives listed below are typically used in such amounts so as to provide their normal attendant functions. Typical amounts for individual components are also set forth below. All the values listed are stated as mass percent active ingredient in the total lubricating oil composition.

| ADDITIVE | MASS % (Broad) | MASS % (Preferred) |
|---|---|---|
| Ashless Dispersant | 0.1–20 | 1–8 |
| Metal Detergents | 0.1–15 | 0.2–9 |
| Corrosion Inhibitor | 0–5 | 0–1.5 |
| Metal Dihydrocarbyl Dithiophosphate | 0.1–6 | 0.1–4 |
| Supplemental Anti-oxidant | 0–5 | 0.01–3 |
| Pour Point Depressant | 0.01–5 | 0.01–1.5 |
| Anti-Foaming Agent | 0–5 | 0.001–0.15 |
| Supplemental Anti-wear Agents | 0–5 | 0–2 |
| Friction Modifier | 0–5 | 0–1.5 |
| Viscosity Modifier | 0.01–6 | 0–4 |
| Synthetic or Synthetic and Mineral Base Stock phthalic acid | Balance (at least 10% ester) | Balance (at least 10% phthalic acid ester) |

The individual additives may be incorporated into a base stock in any convenient way. Thus, each of the components can be added directly to the base stock by dispersing or dissolving it in the base stock at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into base stock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

The concentrate is conveniently made in accordance with the method described in U.S. Pat. No. 4,938,880. That patent describes making a pre-mix of ashless dispersant and metal detergents that is pre-blended at a temperature of at least about 200° C. Thereafter, the pre-mix is cooled to at least 85° C. and the additional components are added.

The final crankcase lubricating oil formulation may employ from 2 to 20 mass % and preferably 5 to 10 mass %, more preferably about 7 to 8 mass % of the concentrate or additive package with the remainder being base stock containing at least 10% by weight phthalic acid esters.

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The viscosity modifier (VM) functions to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Metal-containing or ash-forming detergents function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Detergents that may be used include oil-soluble neutral and overbased sulfonates, phenates, sulfurized phenates, thiophosphonates, salicylates, and nephthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450.

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

Oxidation inhibitors or antioxidants reduce the tendency of base stocks to deteriorate in service which deterioration can be evidenced by the products of oxidation such as sludge and vanish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorous esters, metal thiocarbamates, oil soluble copper compound as described in U.S. Pat. No. 4,867,890, and molybdenum containing compounds.

Friction modifiers may be included to improve fuel economy. Oil-soluble alkoxylated mono- and di-amines are well known to improve boundary layer lubrication. The amines may be used as such or in the form of an adduct or reaction product with a boron compound such as boric oxide, boron halide, metaborate, boric acid or a mono-, di- or tri-alkyl borate.

Other friction modifiers are known. Among these are esters formed by reacting carboxylic acids and anhydrides with alkanols. Other conventional friction modifiers generally consist of a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 114, pp. 675–682 and M. Belzer and S. Jahanmir in "Lubricating Science" (1988), Vol. 1, pp. 3–26. One such example is organo-metallic molybdenum.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are preferably present in an amount not exceeding 0.2 wt. % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil improvers, lower the minimum temperature at which the fluid will flow or can be poured. Such additives are well known. Typical of those additives which improve the low temperature fluidity of the fluid are $C_8$ and $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

EXAMPLE 1

Sequence VIA Screener

The Sequence VIA fuel economy procedure has six operational stages and a 16 hour pre-aging of the oil. The engine is a Ford 4.6L V-8. Fuel economy is determined relative to a base case oil using a weighted sum of the fuel consumption which includes operating power and a scaling factor for each stage. The screener runs Stages 1 and 4 and a 3 hour aging as given below:

| | | Conditions | |
|---|---|---|---|
| | Aging | Stage 1 | Stage 4 |
| Hours | 3 | 1.5 | 1.5 |
| Speed, RPM | 1500 | 800 | 1500 |
| Load, Nm | 98.0 | 26 | 98 |

-continued

| | | Conditions | |
|---|---|---|---|
| | Aging | Stage 1 | Stage 4 |
| Oil Temp, C. | 125 | 105 | 70 |
| Weighting | | 7% | 51% |

EXAMPLE 2

Fuel Economy

Oils tested

Various oil formulations underwent the Sequence VIA Screener test described in Example 1. The oils tested are described in Table 1. An additive package ranging from 20.06 to 22.26% weight of the total composition was used for each oil. There are six candidate oils which differ in ester. The treat rate of ester is 20 wt %. The esters evaluated are tri-methylolpropane octanoate/decanoate, tri-methylolpropane 2-ethyl hexanoate, diisodecyl phthalate, alkyl (c24 average) benzene, tri-methylolpropane oxo-octanoate, and pantaerythritol oxo-octanoate. For comparison, a no ester all PAO base case is included in the design.

Each oil was blended to viscometric targets of 3500 cP ccs at −30° C. and 10.1 cSt kinematic viscosity at 100° C. A 3250 cP ccs is the lower limit of the 5W viscosity range. All of the candidate blends except the tri-methylolpropane octanoate/decanoate allowed for reductions in the ratio of PAO6 to PAO4 relative to the all PAO base case oil. Reductions in the amount of PAO6 are expected to give credits in the hydrodynamic stages of the Sequence VIA.

RESULTS

Results of the Sequence VIA screeners are given in Table 2. All the candidate oils except tri-methylolpropane Octanoate/Decanoate showed increased weighted % Fuel Efficiency Index (FEI) relative to the base case. The weighted FEI of the base case is 1.16%. The tri-methylolpropane 2-ethyl hexanoate, alkyl (c24 average) benzene, tri-methylolpropane oxo-octanoate, and pentaerythritol oxo-octanoate are all greater than 1.5% FEI.

TABLE 1

GF-2 Full Synthetic Sequence VIA Screener Oils

| Additive + Diluent | | 1<br>20.06 | 2<br>21.06 | 3<br>22.46 | 4<br>22.16 | 5<br>22.26 | 6<br>22.06 | 7<br>21.96 |
|---|---|---|---|---|---|---|---|---|
| Basestocks | | | | | | | | |
| 4 cSt poly alpha olefin (PAO4) | (VI = 125) | 15.19 | 10.01 | 35.96 | 39.04 | 21.94 | 46.93 | 58.04 |
| 6 cSt poly alpha olefin (PAO6) | (VI = 135) | 64.75 | 48.93 | 21.58 | 18.80 | 35.80 | 11.01 | |
| Tri-methylolpropane Octanoate/Decanoate | (VI = 124) | | 20.00 | | | | | |
| Tri-methylolpropane 2-ethyl hexanoate | (VI =−28.5) | | | 20.00 | | | | |
| Diisodecyl phthalate | (VI = 55.8) | | | | 20.00 | | | |
| Alkyl (c24 average) Benzene | (VI = 11.5) | | | | | 20.00 | | |
| Tri-methylolpropane Oxo-Octanoate | (VI = 74) | | | | | | 20.00 | |
| Pentaerythritol Oxo-Octanoate | (VI = 89.4) | | | | | | | 20.00 |
| Total | | 100.00 | 100.00 | 100.00 | 100.00 | 100.00 | 100.00 | 100.00 |
| KV100 (cSt) | | 10.10 | 10.93 | 10.26 | 10.19 | 10.23 | 10.04 | 10.00 |
| ccs at −30 C (cP) | | 3210 | 3580 | 3510 | 3410 | 3300 | 3320 | 3350 |

TABLE 2

GF-2 Full Synthetic Sequence VIA Screener Results

| Sample | Oil | Stg1 BCFC | Stg4 BCFC | % Imp Stg1 | % Imp Stg4 | Weighted FEI |
|---|---|---|---|---|---|---|
| 1 | No Ester Base | 686.7600 | 329.0800 | −0.3727 | 1.4435 | 1.1591 |
| 2 | Tri-methylolpropane Octanoate/Decanoate | 677.1300 | 330.3900 | 1.0348 | 1.0512 | 0.9829 |
| 3 | Tri-methylolpropane 2-ethyl hexanoate | 673.5500 | 328.1200 | 1.5580 | 1.7311 | 1.5845 |
| 4 | Diisodecyl phthalate | 687.7600 | 327.9600 | −0.5188 | 1.7790 | 1.4155 |
| 5 | Alkyl (c24 average) Benzene | 681.5100 | 327.6200 | 0.2328 | 1.8479 | 1.5463 |
| 6 | Tri-methylolpropane Oxo-Octanoate | 669.6300 | 328.1800 | 1.9719 | 1.6801 | 1.5847 |
| 7 | Pentaerythritol Oxo-Octanoate | 671.0500 | 328.0700 | 1.7640 | 1.7131 | 1.5906 |

The results show that the esters have improved fuel efficiency performance over the non-ester based synthetic oil.

EXAMPLE 3

Sequence IIIE Wear performance

An ASTM Sequence IIIE test was conducted in order to compare the wear performance of the phthalates to high hydroxyl esters. The test simulates severe high temperature/load field service such as high speed trailer towing.

Wear performance is evaluated as the loss in dimension length of valve lifters and diameters on cam lobes. The average wear reported below in Table 3 is the average lobe/lifter wear loss of 12 lobe/lifter location pairs. The maximum wear loss is the largest wear loss measured on one lobe/lifter location pair.

The operating conditions are as follows. The ASTM Sequence IIIE test operates for 64 hours in a GM 3.8 liter V-6 gasoline engine under high load and temperature conditions. After a 4hour break-in, test operation is steady state at 3000 RPM, 67.8 horsepower, 149° C. oil temperature and 155° C. coolant temperature.

Table 3 below shows the wear results comparing high hydroxyl esters with diisodecyl phthalate (DIDP). Both compositions contain the same additive package and have the same oil weight (0W30).

TABLE 3

Sequence IIIE Wear Performance Results

| Ester | (DIDP)<br>(15% DIDP) | (HHE)<br>(10% HHE) |
|---|---|---|
| Avg. Wear<br>(<30 μm -pass) | 2.60 | 320.1 |
| Max. Wear<br>(<64 μm -pass) | 5.00 | 3218.00 |

The wear performance results show that the phthalate ester significantly improves the wear performance of the engine compared to the high hydroxyl esters. Therefore, the phthalate ester synthetic oil has improved fuel efficiency over the non-ester based synthetic oil and significantly superior wear performance over the high hydroxyl esters.

What is claimed is:

1. A lubricating oil composition comprising from about 50% to about 90% by weight, based on the total weight of the lubricating oil composition, of poly alpha olefin synthetic base oil having a viscosity index of at least 125, and at least 10% by weight, based on the total weight of the lubricating oil composition, of an ester of phthalic acid having a viscosity index of less than 100.

2. The composition of claim 1, wherein said ester of phthalic acid is from about 10 to 50% by weight of the total oil composition.

3. The composition of claim 1, wherein said ester of phthalic acid is from about 15 to 40% by weight of the total oil composition.

4. The composition of claim 1, wherein said ester of phthalic acid has a viscosity index of less than 90.

5. The composition of claim 1 wherein said ester of phthalic acid is selected from the group consisting of:

dioctyl phthalate, didecyl phthalate, didodecyl phthalate, diisoctyl phthalate, diisononyl phthalate, diisodecyl phthalate, diisododecyl phthalate, ditridecyl phthalate, di-n-butyl phthalate, diisobutyl phthalate and mixtures thereof.

6. The composition of claim 4 wherein said ester of phthalic acid is diisodecyl phthalate.

7. A lubricating oil composition of claim 1, wherein said lubricating oil composition comprises from about 60% to about 85% by weight, based on the total weight of the lubricating oil composition, of poly alpha olefin synthetic base oil having a viscosity index of at least 125.

8. A lubricating oil composition of claim 7, wherein said lubricating oil composition comprises from about 65% to about 80% by weight, based on the total weight of the lubricating oil composition, of poly alpha olefin synthetic base oil having a viscosity index of at least 125.

9. A method of improving fuel economy and wear of an internal combustion engine comprising treating moving surfaces of said engine with a lubricating oil composition comprising from about 50% to about 90% by weight, based on the total weight of the lubricating oil composition, of poly alpha olefin synthetic base oil having a viscosity index of at least 125, and at least 10% by weight, based on the total weight of the lubricating oil composition, of an ester of phthalic acid having a viscosity index of less than 100.

10. The method of claim 9, wherein said lubricating oil composition comprises from about 60% to about 85% by weight, based on the total weight of the lubricating oil composition, of poly alpha olefin synthetic base oil having a viscosity index of at least 125.

11. The method of claim 10, wherein said lubricating oil composition comprises from about 65% to about 80% by weight, based on the total weight of the lubricating oil composition, of poly alpha olefin synthetic base oil having a viscosity index of at least 125.

* * * * *